United States Patent [19]

Yoshikawa

[11] 4,456,305

[45] Jun. 26, 1984

[54] SHIELD TUNNELING MACHINE

[75] Inventor: Tadao Yoshikawa, Ibaraki, Japan

[73] Assignee: Hitachi Shipbuilding & Engineering Co., Ltd., Osaka, Japan

[21] Appl. No.: 387,937

[22] Filed: Jun. 14, 1982

[30] Foreign Application Priority Data

Sep. 18, 1981 [JP] Japan ..... 56-139455[U]
Nov. 13, 1981 [JP] Japan ..... 56-169523[U]

[51] Int. Cl.[3] ..... E21D 9/08

[52] U.S. Cl. ..... 299/33; 198/657; 299/56; 299/58; 299/87

[58] Field of Search ..... 299/33, 56, 57, 58, 299/87; 198/657

[56] References Cited

U.S. PATENT DOCUMENTS

| | | | |
|---|---|---|---|
| 1,530,768 | 3/1925 | Hoag | 299/58 |
| 2,665,796 | 1/1954 | Anderson | 198/657 |
| 2,821,374 | 1/1958 | Gardner | 299/58 |
| 2,919,121 | 12/1959 | Ruth | 299/87 |
| 3,158,255 | 11/1964 | Schnyder | 198/657 |
| 4,159,149 | 6/1979 | Gastaroli | 299/87 |
| 4,165,129 | 8/1979 | Sugimoto | 198/657 |
| 4,171,848 | 10/1979 | Ono | 299/33 |

FOREIGN PATENT DOCUMENTS

| | | | |
|---|---|---|---|
| 84525 | 12/1894 | Fed. Rep. of Germany | 299/56 |
| 2207216 | 8/1972 | Fed. Rep. of Germany | 198/657 |
| 2626196 | 6/1976 | Fed. Rep. of Germany | 198/657 |
| 2819240 | 11/1978 | Fed. Rep. of Germany | 198/657 |

*Primary Examiner*—William F. Pate, III
*Attorney, Agent, or Firm*—Barnes, Kisselle, Raisch, Choate, Whittemore & Hulbert

[57] ABSTRACT

A shield tunneling machine having incorporated therein an earth removing apparatus which comprises a tubular casing having an earth inlet at one end and a closable earth outlet at the other end, and an earth transport conveyor rotatably provided within the casing and comprising a helically twisted strip. Unlike conventional earth removing apparatus which has a screw conveyor comprising a rotary shaft and a screw blade around the shaft, the apparatus can transport and discharge earth containing large solid fragments and therefore performs the desired function even when small in diameter, i.e. in shield diameter.

8 Claims, 7 Drawing Figures

SHIELD TUNNELING MACHINE

The present invention relates to a shield tunneling machine, and more particularly to a shield tunneling machine including an efficient earth removing apparatus.

When tunnels are formed by a shield excavating machine, the forward ground is excavated with a cutter head attached to one end of its shield main body, and the earth is taken into a pressure chamber behind the cutter head and passed through an earth removing apparatus into an atmospheric pressure chamber in the rear of the pressure chamber. With conventional earth removing apparatus, the earth is transported by a so-called screw conveyor which has a screw blade around a rotary shaft, so that the size of stones or rocks that can be transported is limited by the shaft which is a hindrance. Accordingly when the diameter of the shield main body is decreased (to excavate a smaller tunnel), the earth removing apparatus used has a correspondingly decreased diameter and is unable to satisfactorily transport and discharge earth which contains large solid fragments, such as cobbles and boulders.

The object of the present invention is to provide an earth removing apparatus which is capable of efficiently discharging large fragments even when having a diametrically small shield main body.

To fulfill this object, the present invention provides a shield tunneling machine which comprises a hollow shield main body; a cutter head rotatably disposed at one end of the main body; a pressure chamber formed within the main body immediately behind the cutter head; an atmospheric pressure compartment formed within the main body in the rear of the pressure chamber; and an earth removing apparatus provided within the main body and holding the pressure chamber in communication with the atmospheric pressure compartment; the earth removing apparatus comprising a tubular casing having at a front end portion thereof an earth inlet opened to the pressure chamber and at a rear end portion thereof a closable earth outlet communicating with the atmospheric pressure compartment, and an earth transport conveyor rotatably provided within the casing and comprising a helically twisted strip.

Since the earth transport conveyor has no rotary shaft according to the above construction, the apparatus is capable of transporting and discharging earth containing relatively large solid fragments (for example, those having $\frac{2}{3}$ the diameter of the casing) even when the shield main body or the tubular casing has a reduced diameter. Furthermore, the strip, which is helically twisted continuously will not resist the earth greatly and is less prone to abrasion.

According to a preferred embodiment of the invention, the rear end portion of the casing is provided with a poking rod which is movable into the casing for collapsing the mass of earth consolidated in the rear portion. The poking rod is hollow and connected to a slime injecting tube, through which slime can be introduced into the casing rear end portion when so desired to give decreased water permeability and improved flowability to the earth in this portion.

According to another preferred embodiment of the invention, an earth kneading blade comprising a helically twisted strip is rotatably provided within the pressure chamber, whereby the excavated earth is thoroughly kneaded with slime within the pressure chamber and thereby rendered less permeable to water and smoothly transportable before being forced into the earth removing apparatus. Consequently the earth can be transported efficiently without causing wear to the conveyor, while the improved sealing properties of the earth permit the internal pressure of the pressure chamber, as well as of the earth removing apparatus, to build up sufficiently to effectively prevent collapse of the forward ground against its earth pressure.

Various other features and advantages of the invention will be readily understood from the embodiments to be described below with reference to the accompanying drawings, in which:

FIG. 1 is a view in longitudinal section showing a shield tunneling machine according to a first embodiment of the invention;

FIG. *2a* to FIG. *2c* are views in section taken along the line II—II in FIG. 1 and showing an earth outlet as provided at various positions;

Throughout the drawings, like parts are referred to by like reference numerals.

Figure 1:
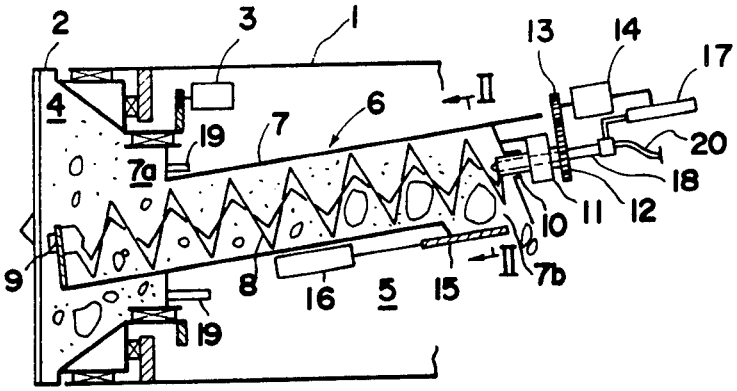

With reference to FIG. 1 showing a first embodiment of the invention, indicated at 1 is a hollow shield main body in conformity with the shape of the tunnel to be excavated. A cutter head 2 rotatable by drive means 3 is rotatably mounted on one end (front end) of the main body 1. Formed within the shield main body 1 are a pressure chamber 4 immediately behind the cutter head 2 and an atmospheric pressure compartment 5 in the rear of the chamber 4. The pressure chamber 4 is in communication with the atmospheric pressure compartment 5 through an earth removing apparatus 6. The excavated earth taken into the pressure chamber 4 through slits formed in the cutter head 2 is transported through the apparatus 6 toward the compartment 5. The earth removing apparatus 6 consists essentially of a tubular casing 7 having at a front end portion thereof an earth inlet *7a* opened to the pressure chamber 4 and at a rear end portion thereof an earth outlet *7b* communicating with the atmospheric pressure compartment 5, and an earth transport conveyor 8 rotatably provided within the casing 7 and comprising a helically twisted strip. The conveyor 8 has one end rotatably supported on the front end of the casing 7 by a bearing 9 and the other end provided with a hollow end shaft 10 which is rotatably supported by a bearing 11 on the rear end of the casing 7. The conveyor 8 is coupled to drive means 14 by a driven gear 12 fixed to the end shaft 10 and a drive pinion 13 meshing with the gear 12. A gate 15 for closing the earth outlet *7b* is operated by cylinder means 16. As seen in FIGS. *2a* to *2c*, the earth outlet *7b* can be formed in a lower, lateral or bottom portion of the casing 7 so that the earth will be discharged tangentially of the casing.

The pressure chamber 4 is provided with injection pipes 19 in communication therewith for injecting slime into the chamber 4 therethrough. A poking rod 18 slidably extending through the end shaft 10 of the conveyor 8 is movable into the casing 7 by cylinder means 17 so that the portion of earth consolidated in the rear portion of the casing 7 can be collapsed by the poking rod 18. The poking rod 18 is connected to a tube 20 through which slime is injected into the casing 7. The slime mentioned is used to give lubricity to the earth, reduce its shearing force and clog up the interstices between the earth particles.

The earth excavated by the cutter head 2 of the above apparatus is taken into the pressure chamber 4 through the slits of the head 2, forced into the tubular casing 7 along with the slime injected through the pipes 19, transported by the conveyor 8 while being efficiently kneaded, and discharged from the earth outlet 7*b*. Since the interstices between the particles of excavated earth are clogged up by being thus kneaded with the slime, the earth is made less permeable to water to prevent escape of underground water. Further because the internal pressure of the chamber 4, as well as the casing 7, can be built up by limiting the amount of discharge of earth with the gate 15, the increased pressure prevents the forward ground from collapsing against its earth pressure. If the excavated earth is consolidated in the rear portion of the casing 7, the mass of earth is collapsed by the poking rod 18. When it is required to give sealing properties to the earth in the vicinity of the gate 15, slime is injected into the casing through the tube 20 and the poking rod 18.

Figure 2A:
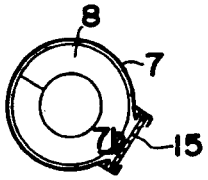
Figure 2B:
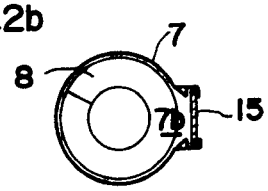
Figure 2C:
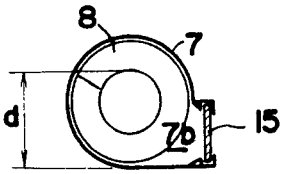

When the conveyor strip 8 is used, the sizes of cobbles or fragments of rocks that can be discharged are up to as large as the height d of the upper end of the inner periphery of the conveyor strip 8 from the inner bottom surface of the casing 7 as shown in FIG. 2*c*. Thus the conveyor can handle much larger fragments than the conventional screw conveyor having a rotary shaft.

Figure 3:
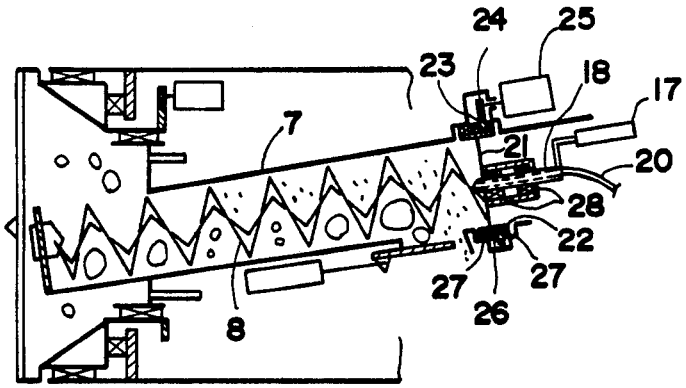
FIG. 3 is a view in longitudinal section showing a modification of the first embodiment.

The modification of FIG. 3 differs from the embodiment of FIG. 1 only in the arrangement for driving the conveyor 8. The conveyor strip 8 is provided at its rear end with a rotary disk 21 approximately equal to the conveyor 8 in outside diameter. An annular member 22 fixed to the outer periphery of the disk 21 has a driven gear 23. The conveyor 8 is coupled to drive means 25 by the gear 23 and a drive pinion 24. A bearing 26 is disposed in an annular recess of the casing 7 for supporting the annular member 22 and is provided with seals 27 on its opposite sides. Since the disk 21 rotates, the poking rod 18 is supported by a bearing 28.

Figure 4:
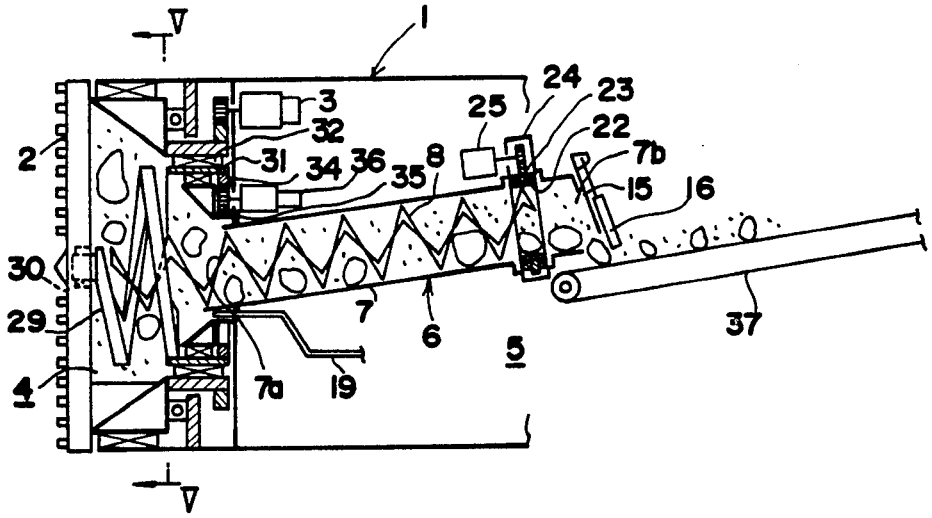
FIG. 4 is a view in longitudinal section showing a second embodiment of the invention.
Figure 5:
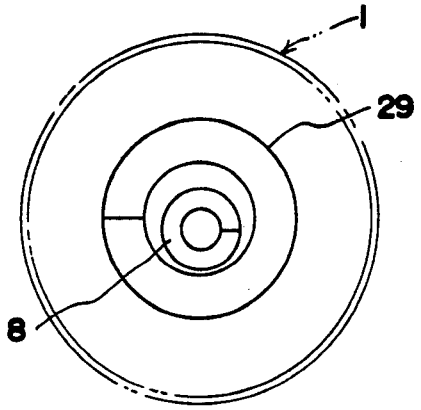
FIG. 5 is a view in section taken along the line V—V in FIG. 4.

With reference to FIGS. 4 and 5, a second embodiment of the invention will now be described. The shield tunneling machine of this embodiment essentially differs from those of FIGS. 1 and 3 in that in addition to the earth transport conveyor 8, an earth kneading blade 29 is provided for kneading the earth with the slime from the injection pipes 19 within the pressure chamber 4 more effectively. More specifically, the kneading blade 29 is in the form of a helically twisted strip surrounding the front end portion of the conveyor 8. The blade 29 has one end rotatably supported by a bearing 30 at the center of rotation of the cutter head 2 and the other end supported by an annular member 31 attached to the outer periphery of the strip 29 and by a bearing 32 on a frustoconical wall 33 defining the pressure chamber 4. The kneading blade 29 is rotated by drive means 36 through a driven gear 34 attached to the annular member 31 and a drive pinion 35. The conveyor 8 is rotatably supported on the casing 7 by an annular member 22 which is attached directly to the outer periphery of the rear end of the conveyor 8. The rear end of the casing 7 has an earth outlet 7*b*. Although not shown in FIGS. 1 and 3, a belt conveyor or like transfer conveyor 37 is actually disposed subsequent to the earth removing apparatus 6 for delivering the excavated earth from the outlet 7*b* to a suitable location.

Because the second embodiment of the foregoing construction has the earth kneading blade 29, the earth can be thoroughly kneaded with slime before advancing into the apparatus 6 to effectively build up pressure within the pressure chamber 4 and the casing 7 against the collapsing earth pressure of the ground confronting the apparatus.

The kneading blade 29, although supported at two points, i.e. by the bearings 30 and 32, may be supported at only one end with the bearing 30 eliminated. The conveyor 8 need not extend into the pressure chamber 4, provided that it extends approximately over the entire length of the casing 7. As in the embodiments of FIGS. 1 and 3, the casing 7 can be provided with a poking rod and a slime injecting tube at its rear end portion.

Although the kneading blade 29 is supported by the annular member 31 on the wall 33 of the pressure chamber 4 in FIG. 4, the kneading blade 29 may be supported on the outer periphery of the casing 7 by an annular member having a smaller diameter and fixed to the inner periphery of the blade. In the latter case, a bearing ring can be interposed between the annular member and the outer periphery of the casing 7 to dispose an oil supply pipe in an annular space formed between the casing outer periphery and the bearing ring.

What is claimed is:

1. A shield tunneling machine comprising:

a hollow sheild main body;

a cutter head rotatably disposed at one end of the main body and adapted to be driven by first drive means;

a pressure chamber formed within the main body immediately behind the cutter head;

an atmospheric pressure compartment formed within the main body in the rear of the pressure chamber;

shaftless earth kneading screw means comprising a helically twisted strip rotatably provided within the pressure chamber, the earth kneading screw means being adapted to be driven by second drive means for kneading the excavated earth introduced into the pressure chamber through the cutter head; and an earth removing apparatus provided within the main body and holding the pressure chamber in communication with the atmospheric pressure compartment; the earth removing apparatus comprising a fixed tubular casing having at a front end portion thereof an earth inlet opened to the pressure chamber and at a rear end portion thereof a closable earth outlet communicating with the atmospheric pressure compartment, and a shaftless screw conveyor comprising a helically twisted strip rotatably provided within the casing, the screw conveyor being adapted to be driven by third drive means for conveying the excavated earth introduced into the casing through the earth inlet.

2. A shield tunneling machine as defined in claim 1 wherein the earth conveying strip has a front end portion extending into the pressure chamber and surrounded by the earth kneading strip.

3. A shield tunneling machine as defined in claim 1 wherein an annular member rotatably arranged radially outwardly of the casing is fixed to a rear end portion of the earth kneading strip, the earth kneading strip being adapted to be rotated by the second drive means through the annular member.

4. A shield tunneling machine as defined in claim 3 wherein the annular member carries an annular driven gear, and the second drive means comprising a drive pinion in mesh with the annular driven gear.

5. A shield tunneling machine as defined in claim 3 wherein the annular member is rotatably supported on a wall defining the pressure chamber and fixed to the outer periphery of the rear end portion of the earth kneading strip.

6. A shield tunneling machine as defined in claim 1 wherein the front end of the earth kneading strip is rotatably supported at the center of rotation of the cutter head.

7. A shield tunneling machine as defined in claim 1 wherein the earth conveying strip is rotatably supported on the casing via an annular member attached to the outer periphery of the earth conveying strip and rotatably received in an annular recess formed in the casing.

8. A shield tunneling machine as defined in claim 7 wherein the annular member carries an annular driven gear, and the third drive means comprises a drive pinion in mesh with the driven gear.

* * * * *